US006000975A

United States Patent [19]

Feldman

[11] Patent Number: 6,000,975

[45] Date of Patent: Dec. 14, 1999

[54] CANTED BEAM ELECTRICAL CONTACT AND RECEPTACLE HOUSING THEREFOR

[75] Inventor: Steven Feldman, Madison, Ohio

[73] Assignee: 3M Innovative Properties Company, Saint Paul, Minn.

[21] Appl. No.: 08/990,037

[22] Filed: Dec. 12, 1997

[51] Int. Cl.[6] ..... H01R 11/22

[52] U.S. Cl. ..... 439/857

[58] Field of Search ..... 439/857, 856

[56] References Cited

U.S. PATENT DOCUMENTS

| | | | |
|---|---|---|---|
| 3,838,388 | 9/1974 | Bauerle et al. | 439/857 |
| 4,140,361 | 2/1979 | Sochor | 339/258 P |
| 4,150,863 | 4/1979 | Krafthefer et al. | 439/629 |
| 4,379,611 | 4/1983 | Foege et al. | 439/747 |
| 4,480,386 | 11/1984 | Adams | 29/874 |
| 4,591,230 | 5/1986 | Roldan | 339/258 R |
| 4,607,907 | 8/1986 | Bogursky | 339/258 P |
| 4,678,278 | 7/1987 | Friesen et al. | 350/319 |
| 4,687,278 | 8/1987 | Grabbe et al. | 439/842 |
| 4,702,545 | 10/1987 | Moyaert | 439/856 |
| 4,720,277 | 1/1988 | Sakamoto | 439/842 |
| 4,722,704 | 2/1988 | VanDerStuyf et al. | 439/851 |
| 4,772,234 | 9/1988 | Cooper | 439/851 |
| 4,776,651 | 10/1988 | Paulo | 439/857 |
| 4,874,338 | 10/1989 | Bakermans | 439/851 |
| 4,909,746 | 3/1990 | Scholz | 439/82 |
| 4,918,813 | 4/1990 | Mori et al. | 29/874 |
| 4,975,084 | 12/1990 | Fedder et al. | 439/608 |
| 5,080,597 | 1/1992 | Seidel et al. | 439/108 |
| 5,183,421 | 2/1993 | Yin | 439/857 |
| 5,334,053 | 8/1994 | Noschese | 439/682 |
| 5,472,358 | 12/1995 | Tan et al. | 439/851 |
| 5,597,324 | 1/1997 | Katsunori | 439/587 |
| 5,611,717 | 3/1997 | Joly | 439/857 |
| 5,683,274 | 11/1997 | Straeb et al. | 439/839 |
| 5,797,774 | 8/1998 | Kaneko | 439/857 |
| 5,860,838 | 1/1999 | Kaneko | 439/857 |

FOREIGN PATENT DOCUMENTS

| | | | |
|---|---|---|---|
| 0 219 935 A2 | 8/1986 | European Pat. Off. | H01R 43/16 |
| 0308068 | 3/1989 | European Pat. Off. | 439/857 |
| 0 429 177 A1 | 5/1991 | European Pat. Off. | H01R 13/20 |
| 000571105 | 11/1993 | European Pat. Off. | 439/856 |
| 1187074 | 9/1959 | France | 439/857 |
| 3424072 | 1/1986 | Germany | 439/857 |
| 004034941 | 9/1991 | Germany | 439/857 |
| 41 20 792 A1 | 1/1992 | Germany | H01R 13/11 |
| WO 092004746 | 3/1992 | WIPO | 439/856 |
| WO 96/30969 | 10/1996 | WIPO | H01R 13/11 |

*Primary Examiner*—Neil Abrams
*Assistant Examiner*—Michael C. Farroli
*Attorney, Agent, or Firm*—Matthew B. McNutt

[57] ABSTRACT

A stamped electrical socket contact for connection to a contact pin which is inserted along a pin insertion axis, and a method for forming such a socket contact. The socket contact includes a body portion from which a first longitudinal beam and a second longitudinal beam extend. The first and second beams are positioned about a central plane. When viewed from a direction normal to the central plane, the first and second beams intersect the pin insertion axis at an acute angle.

15 Claims, 7 Drawing Sheets

CANTED BEAM ELECTRICAL CONTACT AND RECEPTACLE HOUSING THEREFOR

BACKGROUND OF THE INVENTION

The present invention relates to socket contacts which can be installed in a housing with a small spacing between the contacts for connection to a corresponding array of conductive pins that are insertable into the socket contacts to form an electrical connection.

Receptacle-type contacts are commonly manufactured by stamping a metal sheet to provide a carrier strip carrying a plurality of socket contact blanks. The contact blanks are subsequently bent into an appropriate shape, and the formed contacts are then inserted into a connector housing. Typically, the plurality of formed contacts on the carrier strip are inserted into the housing as a single unit ("gang insertion"), thereby simplifying and speeding the assembly process.

To permit multiple contacts to be inserted into the housing as a single unit, the contacts must be spaced from each other on the carrier strip by a distance which is an integral multiple of the pitch of the conductive pins which will mate with the contacts. It is preferred that the center-to-center spacing (e.g., pitch) of the formed contacts on the carrier strip equals the pitch of the conductive pins, so that only a single contact insertion step is required when installing a row of contacts in the connector housing. If the pitch of the contacts on the carrier strip is greater than the pitch of the conductive pins, multiple contact insertion steps are required to install a single row of contacts. For example, if the pitch of the contacts on the carrier strip is two times the pitch of the conductive pins, two insertion steps are necessary, with each insertion step installing one half (e.g., every other contact) of the row of contacts into the connector housing.

If the pitch of the finished contacts is to equal the pitch of the finished connector, then the width of each contact blank cannot be greater than the pitch of the finished contacts. Because there is a continuing trend toward miniaturization of connectors, the pitch of the connector pins and contacts (and thus the width of the contact blanks) is continually decreasing. As the pitch decreases, the formation of socket contacts using a stamping and bending procedure becomes increasingly difficult for dual beam contacts with oppositely disposed wipers. When the pitch of the connector becomes less than or equal to the maximum pin diameter times pi (e.g., circuit pitch $\leqq D_{max}\,\pi$), a shortage of material occurs in the contact blank. That is, the amount of material required to form the contact blank is larger than the amount of available material on the carrier strip.

The material shortage problem is illustrated in FIG. 1A and FIG. 1B. FIG. 1A shows an example of a known socket contact 2 having a shank 4 and wipers 6 extending from shank 4. Wipers 6 are bent toward each other so as to capture a contact pin (not shown in FIG. 1A) inserted between wipers 6. It is desired to have the centerlines of wipers 6 align with the centerline of contact pin 8, so that uniform normal forces are applied to contact pin 8. FIG. 1B shows a cross section of socket contact 2 along line 1B—1B of FIG. 1A, with a contact pin 8 inserted into socket contact 2. As shown in FIG. 1B, contact pin 8 has a diameter of 0.018 inch, the socket contact 2 has a material width of 0.005 inch, wipers 6 have a half-width of 0.0055 inch, and a clearance of 0.001 inch is provided between shank 6 of contact pin 8 and socket contact 2. The centerline of socket contact 2 thus has a radius R of 0.0125 inch from the center of contact pin 8. The width of material needed to form socket contact 2 is the sum total of: 1) the centerline length of the curved portion of socket contact 2 ($\pi R$ =0.0393 inches ); 2) one half the width of each wiper 6 (0.0055 ×2=0.0110 inches); and 3) the contact singulation width (0.0040 inches). The singulation width is the amount of material needed to account for separation of the individual contacts. Thus, to form shaped socket contact 2, a flat blank width of 0.0543 inch is required. If the pitch of the connector is 0.05 inch, for example, there will be a material shortage of 0.0043 inch, and the centerlines of wipers 6 of the formed socket contact 2 will not be positioned opposite each other on the centerline of contact pin 8.

When a material shortage occurs with the type of socket contact illustrated in FIG. 1A and FIG. 1B, there have been attempts to bring the wiper centerlines into alignment with the contact pin centerline by stretching the blanked material in the direction of arrows 9 during the shaping processes. However, this results in an unstable forming process and thus produces manufacturing difficulties. In addition, assembly issues also arise in attempting to control the contact location within the housing aperture to prevent the wiper edges from being the sole contact points which engage the pin.

There are some socket contacts stamped on connector pitch when the pitch is less than or equal to the maximum pin diameter times pi. For example, International Publication No. WO 9630969 nests the contact spring arms by staggering their position along the pin insertion axis. The resulting geometry provides a formed contact having one rigid contact beam and one compliant contact beam, with the contact points of the beams being offset along the pin insertion axis. The offset contact points cause unequal normal forces to be applied to the contact pin, which in turn results in undesirable pivoting of the contact on the pin. To ensure that both contact beams wipe the pin and to compensate for small variations in pin location, the contact body is stamped with a compliant waist having a reduced cross section. The reduced cross section of the contact causes current crowding in the area of the waist, and further encourages undesirable pivoting of the contact on the pin.

It is also known to deal with the material shortage problem by stamping and forming the socket contacts at slightly greater than connector pitch, and then pleating the carrier strip to move the formed contacts into an on pitch spacing. This method also has drawbacks, primarily that the pleated carrier strip is easily stretched. Thus, a complicated and expensive handling system is required for pleated carrier strips.

Because of the material shortage problem illustrated above, the majority of connector systems which have a circuit pitch which is less than or equal to the maximum pin diameter times pi, such as CompactFlash, PCMCIA and PCMIDE connectors, stamp the receptacle contacts on twice the circuit pitch. Prior art receptacle contacts of this type are exemplified in U.S. Pat. Nos. 4,678,278; 4,722,704; 4,874,338; 4,909,746; 4,720,277; and 5,597,324.

One type of receptacle socket contact is known as a dual-beam receptacle socket contact. One embodiment of such a contact is illustrated in FIG. 1A. A contact of this type includes a pair of resilient beams configured to grasp a conductive pin therebetween. The beams are disposed to contact opposite sides of a conductive pin inserted into the connector, and are formed to produce a contact force sufficiently low to allow easy pin insertion while at the same time providing the required contact force for long term ohmic contact upon insertion of the pin. The contact force must be sufficiently low to prevent undesirably high insertion force, plating wear, and bending of the pins during insertion while accommodating some variance in the positioning of individual pins, but high enough to ensure consistent electrical contact with the pin. Dual beam sockets are disclosed, for example, in U.S. Pat. Nos. 4,140,361; 4,591,230; 4,607,907; and 4,702,545.

What is needed is a socket contact which can be stamped from a flat metal sheet on connector pitch when pitch is less than or equal to pi times the maximum pin diameter, and which reduces or overcomes the disadvantages of the prior art socket contacts.

SUMMARY OF THE INVENTION

The present invention provides a dual-beam socket contact for receiving a contact pin. The socket contact can be formed by stamping a flat metal sheet to produce a plurality of such contacts having a small center-to-center spacing. The inventive contact can be stamped on connector pitch when the pitch is less than or equal to pi times the maximum diameter of the contact pin, while still allowing the centerline of the beams to intersect the centerline of the contact pin.

A preferred embodiment of the contact includes a body portion from which a shank extends. A first beam and a second beam extend from the shank. A central reference plane is coincident with the pin insertion axis and centrally located between the first beam and the second beam. The first and second beams may form mirror images of each other about the central plane. When viewed from a direction normal to the central plane, first beam and the second beam intersect the pin insertion axis at an acute angle.

The electrical socket contact may be inserted into an electrical connector housing having a contact receptacle for receiving the socket contact. The housing may have a plurality of contact receptacles for receiving a plurality of socket contacts.

A method of forming the electrical socket contact includes the steps of stamping a flat contact blank, where the flat contact blank defines a base plane and further has a central reference plane oriented coincident to a pin insertion axis and normal to the base plane. The blank includes a body portion, a longitudinal shank extending from the body portion and in parallel alignment with a pin insertion axis, and a first longitudinal beam extending from a first edge of the shank and a second longitudinal beam extending from an opposing second edge of the shank. The first and second longitudinal beams are in parallel alignment with the shank. The method further includes bending the first longitudinal beam along a first line which forms an acute angle with the pin insertion axis when viewed from a direction normal to the base plane, such that the longitudinal first beam intersects the pin insertion axis at an acute angle when viewed from a direction normal to the central plane; and bending the second longitudinal beam along a second line which forms an acute angle with the pin insertion axis when viewed from a direction normal to the base plane, such that the longitudinal second beam intersects the pin insertion axis at an acute angle when viewed from a direction normal to the central plane.

DETAILED DESCRIPTION OF THE INVENTION

Figure 2:
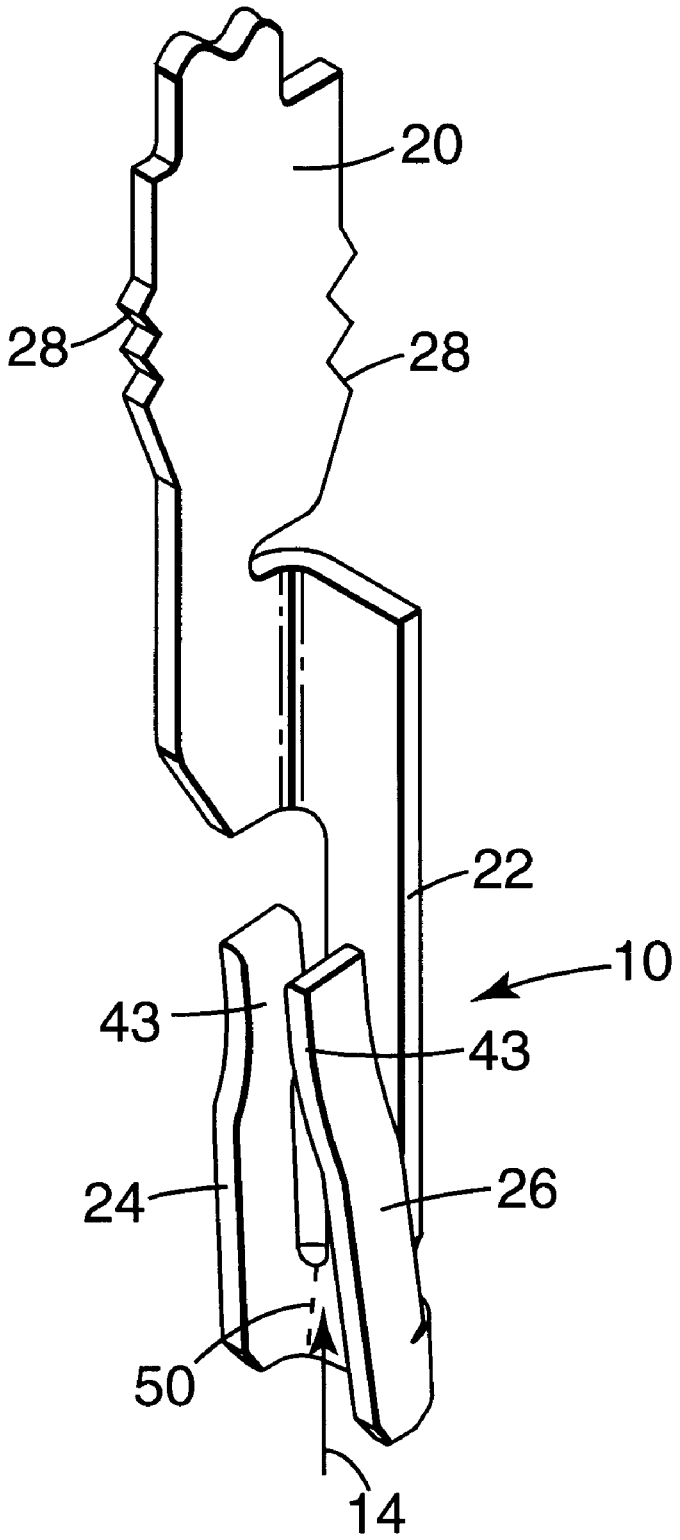
FIG. 2 is a perspective view of a preferred embodiment of the inventive socket contact.

FIG. 2 illustrates a preferred embodiment of a dual beam socket contact 10 according to the present invention. The contact 10 is formed by stamping a pattern for a plurality of such contacts in a flat metal blank and then bending portions of the contact blank to form the final contact structure as illustrated in FIG. 2.

The socket contact 10 is adapted for receiving a contact pin (not shown in FIG. 2) along a pin insertion axis 14. Pin insertion axis 14 coincides with the centerline of the contact pin. Socket contact 10 includes a body portion 20, a shank 22, a first beam 24, and a second beam 26. Body portion 20, at the rear end of the socket contact 10, is an enlarged portion by which the contact 10 will be securely held in a receptacle of a connector housing (not shown). Such connector housing and receptacle are typically made of a thermoplastic material, and are described in greater detail below. Preferably, body portion 20 is provided with barbs 28 for engaging the receptacle walls and thereby assisting the retention of contact 10 within the receptacle.

Figure 3:
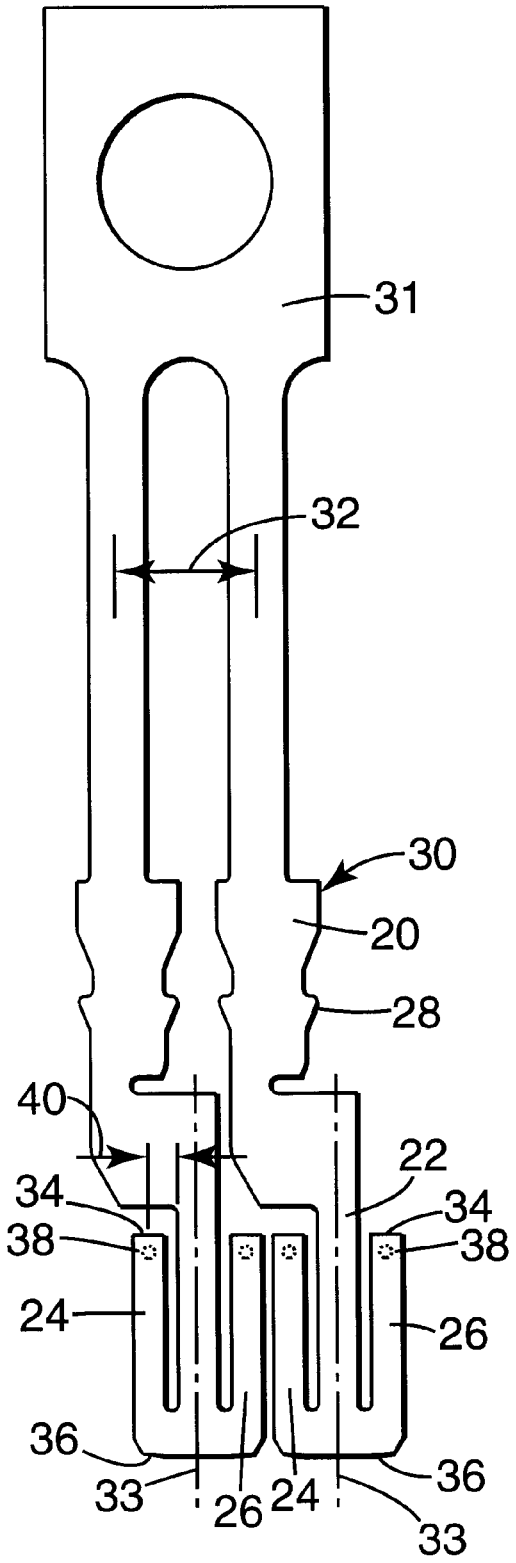
FIG. 3 is a plan view of a socket contact blank according to the present invention.

As shown in FIG. 3, socket contact 10 is stamped from a flat metal blank. A plurality of socket contact blanks 30 are connected by a carrier strip 31 which carries the socket contact blanks 30 through the subsequent bending and shaping steps which form the finished contact 10. On the carrier strip, the socket contact blanks 30 are separated by a distance 32 which is equal to the pitch of the connector. In this manner, it is possible to gang-insert finished socket contacts 10 into contact receptacles in a connector housing. After insertion, the carrier strip is removed from the socket contacts and disposed.

Socket contact blank 30 defines a base plane and includes the above-mentioned body portion 20, shank 22, first beam 24 and second beam 26. First beam 24 and second beam 26 form mirror images of each other about a central plane 33 which extends between the first and second beams 22, 24 and is normal to the base plane defined by the contact blank 30. First beam 24 and second beam 26 each include a free distal end 34 and a proximal end 36 which is cantilevered to shank 22. It will be noted that prior to forming the finished socket contact 10, first beam 24 and second beam 26 are in parallel alignment with shank 22, and the contact points 38 of first beam 24 and second beam 26 are spaced from shank 22 by a distance 40. To form the finished contact 10, a series of bending and shaping steps is performed.

Figure 4:
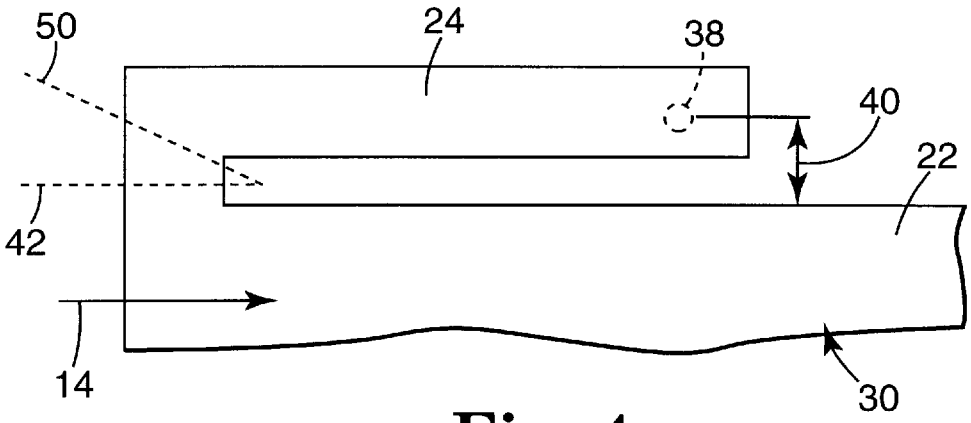
FIG. 4 is an enlarged portion of the socket contact blank of FIG. 3.

A greatly enlarged portion of a contact blank 30, showing only a single contact beam 24, is illustrated in FIG. 4. In a conventional socket contact, the contact is shaped by bending first beam 24 along line 42, while second beam 26 (not shown) is bent along a like line on the opposite half of the blank 30. In this manner, first beam 24 and second beam 26 are made generally perpendicular to the base plane of contact blank 30. First beam 24 and second beam 26 typically also undergo additional shaping, as seen in FIG. 2, to provide a ramped surface 43 for engaging a contact pin therebetween.

Figure 1A:
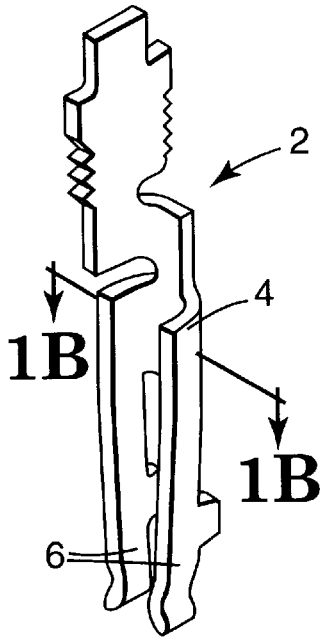
Fig. 1A Prior Art
FIG. 1A is a perspective view of a prior art socket contact.
Figure 1B:
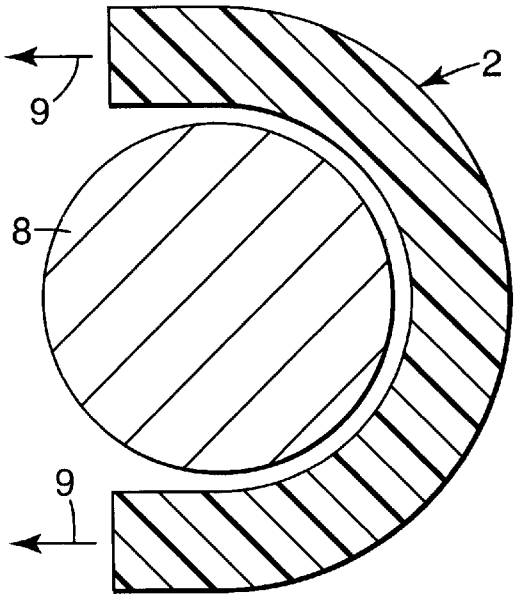
Fig. 1B Prior Art
FIG. 1B is a cross-sectional view taken along line 1B–1B of FIG. 1A.
Figure 5:
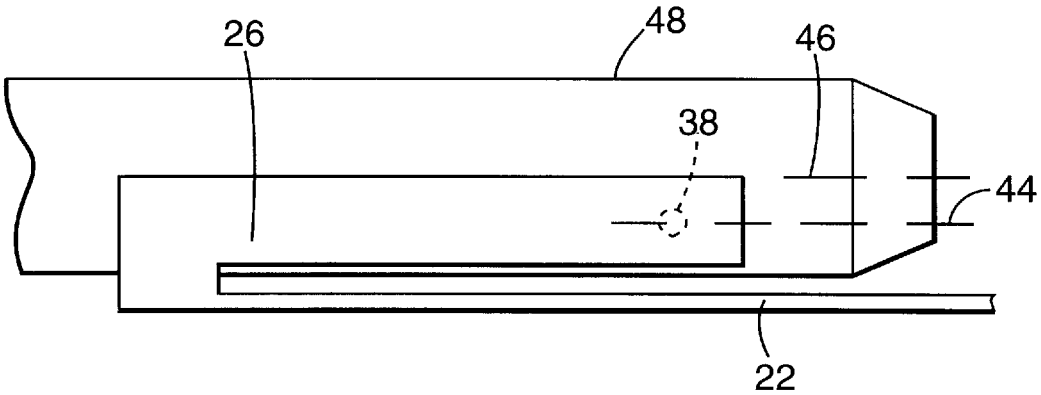
Fig. 5 Prior Art
FIG. 5 is an elevational view of a portion of a socket contact formed in the conventional manner.

As can be seen from FIG. 5, bending first beam 24 and second beam 26 along line 42 in the conventional manner places the beam contact point 38 along axis 44. FIG. 5 illustrates the "material shortage" problem (described above in the Background section and further illustrated in FIG. 1B) which occurs when the connector pitch is less than or equal to the maximum pin diameter times pi. The material shortage results in the beam contact points 38 failing to align with the pin centerline 46.

When beam contact point 38 does not align with centerline 46 of contact pin 48, the electrical connection between socket contact 10 and pin 48 is less reliable for several reasons. When first beam 24 and second beam 26 are not positioned absolutely opposite each other on the pin centerline, the beams exert non-uniform normal forces on the pin which may damage the pin and which also encourage undesirable contact rotation. Additionally, when the beam contact point does not align with the pin centerline, only the edge of the beam tends to contact the pin. This is undesirable because, as the contact ages, corrosion tends to develop and reduce the effective contact area of electrical contact. When only the edge of the beam is in contact with the pin, the initial contact area is much smaller, and the eventual corrosion thus impacts the connection performance in a shorter period of time. This problem is exacerbated by the tendency of such corrosion to initiate at the edges of the beam.

Figure 6:
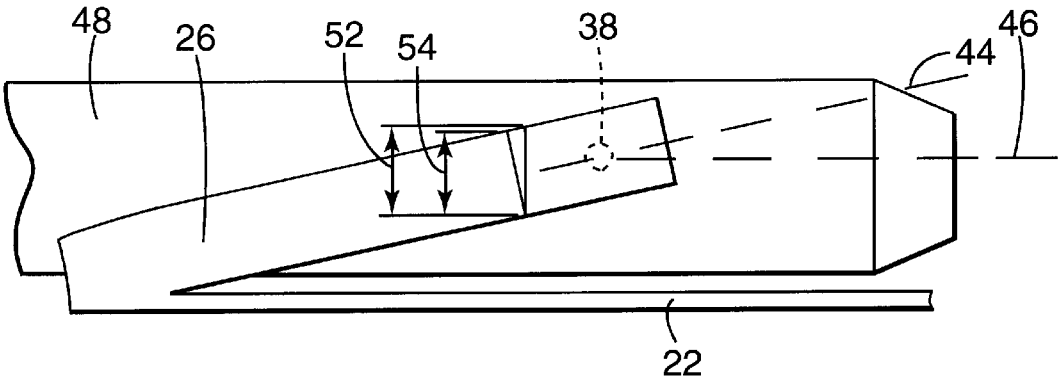
FIG. 6 is an elevational view of a portion of a socket contact formed according to the present application.

In the inventive contact described herein, first beam 24 is bent along a divergent line 50 which forms an acute angle with pin insertion axis 14 when viewed from a direction normal to the base plane (defined by contact blank 30). Bending first beam 22 along line 50 cants or angles first beam 24 upward from the plane of shank 22 to enable first beam 24 to engage mating contact pin 48 along the pin centerline 46. Of course, opposing second beam 26 is bent along a similar divergent line on the opposite half of the contact blank 30. As best seen in FIG. 6, the divergent bend line 50 moves the contact point 38 of the first and second beams 24, 26 into engagement with the centerline 46 of the mating pin 48, and causes first and second beams 22, 24 to form an acute angle with pin centerline 46. The bending along divergent line 50 thus permits the design of contacts which can be stamped on socket pitch while keeping the beam contact point 38 coincident with the pin centerline 46. The invention thus employs a novel socket contact geometry to overcome the material shortage problem encountered by other socket contacts, when the connector pitch is less than or equal to the maximum pin diameter times pi.

In addition to overcoming the material shortage problem of prior socket contacts, the bending of first beam 24 along divergent line 50 (and the bending of second beam 26 along a corresponding line) provides other significant advantages to the inventive socket contact. As can be seen in FIGS. 2 and 4, when beam 24 is bent along line 50, rather than line 42, the contact 10 is provided with a funnel-shaped lead-in for pin 48. The funnel-shaped lead-in eases the entry of pin 48 into socket contact 10 and helps prevent stubbing of pin 48 on the end of contact 10.

A further advantage of the canted contact beam is shown in FIG. 6. A canted beam provides a wider target area for contact pin 48 than would a beam which is formed to align in parallel with the axis of pin 48. As shown in FIG. 6, a canted beam presents a target area of width 52 for pin 48, while the same beam, if it were aligned in parallel with the axis 46 of pin 48, would only present a target area of width 54. The canted beam of the present invention is therefor more tolerant of pin-to-socket misalignment than conventional socket contacts having identically sized contact beams. Alternatively, a narrower canted contact beam can present the same target area as a wider beam which is aligned with the pin axis.

Figure 7:
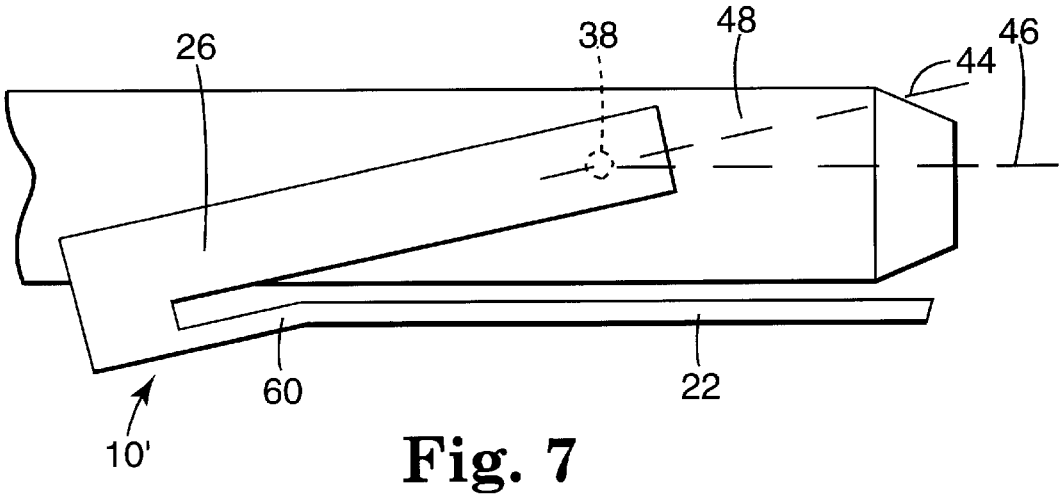
FIG. 7 is an elevational view of an alternative embodiment of the inventive socket contact.

An alternative embodiment of the socket contact is shown in FIG. 7. In the socket contact 10' of FIG. 7, contact beams 24, 26 have been bent in the conventional manner (as illustrated in FIG. 5), and a transverse bend 60 has been made in shank 22 such that the axis 44 of the beam diverges at an acute angle from the base plane defined by the contact blank. In this manner, the axis 44 of the beam is caused to intersect the centerline 46 of pin 48 (when viewed from a direction normal to central plane 33) and thereby provide the same benefits as described above for the preferred embodiment.

Figure 8A:
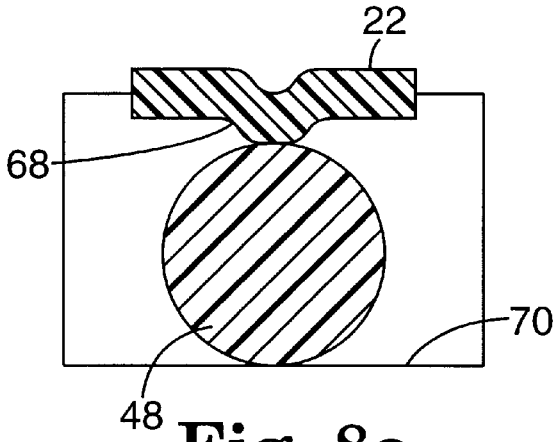
Fig. 8a Prior Art
FIGS. 8*a* and 8*b* are cross-sectional views of prior art shank stiffening features.
Figure 8B:
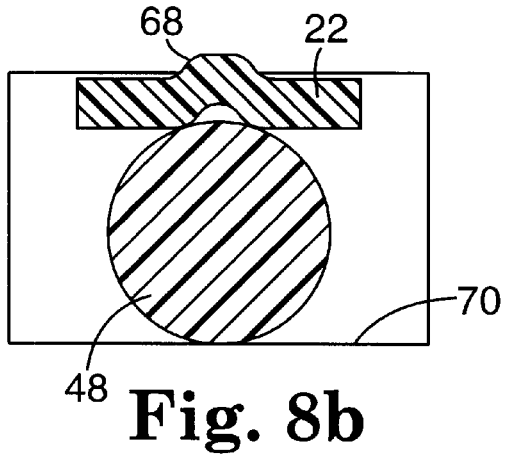
Fig. 8b Prior Art
Figure 8C:
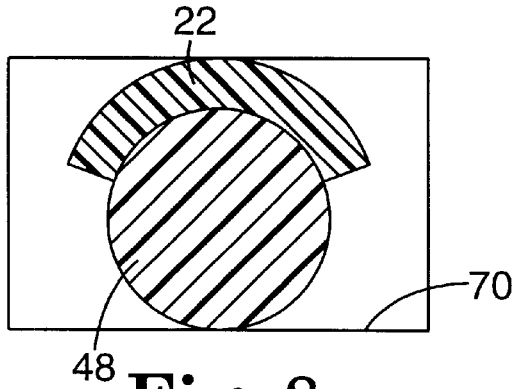
FIG. 8*c* is a cross-sectional view of a preferred shank stiffening feature.

It is preferred that shank 22 of socket contact 10, 10' have a stiffening feature which reduces flexure of shank 22 along its longitudinal axis. FIGS. 8*a*–8*c*schematically illustrate a cross sectional view of shank 22 and contact pin 48 when the contact is positioned in a connector receptacle 70. Clearances between pin 48 and shank 22 are not shown for simplification. Stiffening features known to be used in prior art contacts are shown in FIGS. 8*a* and 8*b*. As can be seen, shank 22 in FIGS. 8a and 8b is provided with a sharp ridge 68 extending along the longitudinal axis of shank 22 (which extends into the plane of the Figures).

Ridge 68 successfully reduces the ability of shank 22 to flex along its longitudinal axis, but produces several disadvantages as well. Specifically, ridge 68 requires that receptacle 70 which receives the contact be made large enough to accommodate ridge 68 on shank 22. As connector pitch becomes smaller, the wall thickness between adjacent receptacles becomes correspondingly thinner. This in turn leads to reduced strength of the connector housing 72, and greater difficulty in molding the connector housing 72. It is therefor desirable to reduce the size of receptacle 70, and thereby permit greater wall thickness and easier component molding.

Accordingly, contact 10, 10' of the present invention is preferably provided with a shank 22 having a curved cross-section which follows the contour of pin 48, as illustrated in FIG. 8*c*. The curved cross section of shank 22 shown in FIG. 8*c* reduces the ability of shank 22 to flex along its longitudinal axis, while at the same time allowing receptacle 70 to be reduced in size. The latter benefit is clearly seen when comparing FIG. 8*c* to FIGS. 8*a* and 8*b*, where the size of each receptacle 70 is identical in each of FIGS. 8*a* –8*c*. The contact in FIG. 8*c* having the shank with a curved cross section is capable of fitting within the receptacle 70, while the contacts of FIGS. 8*a* and 8*b* do not fit within the confines of receptacle 70.

Figure 9:
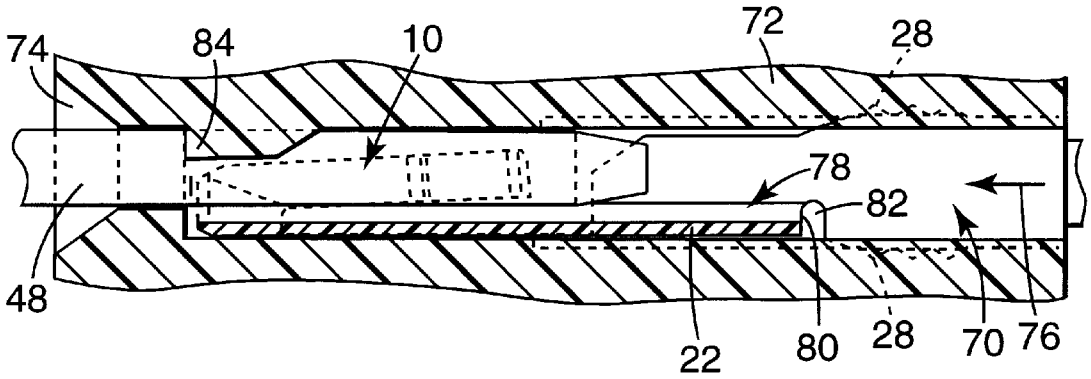
FIG. 9 is a sectional view of a connector receptacle containing the socket contact of FIGS. 2 and 6.
Figure 10:
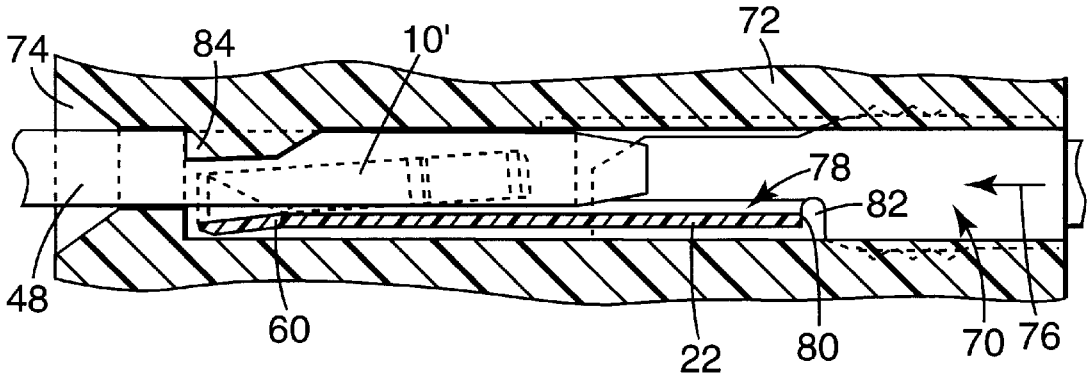
FIG. 10 is a sectional view of a connector receptacle containing the alternative socket contact of FIG. 7.

Referring to FIGS. 9 and 10, there is shown a portion of a receptacle 70 which contains a socket contact 10 according to the invention. FIG. 9 shows the receptacle with the preferred socket contact of FIGS. 2 and 5, while FIG. 10 shows the alternative embodiment of the socket contact of FIG. 7. The receptacle 70 is formed in a housing 72 adapted to provide a plurality of receptacles 70 and to thereby hold a plurality of contacts 10. It will be understood that housing. 72 includes a plurality of receptacles 70 which are spaced apart in a direction perpendicular to the plane of FIGS. 9 and 10. It will be further understood that housing 72 may include multiple receptacles 70 in the plane of FIGS. 9 and 10, although only a single receptacle 70 is shown. Housing 72 includes a pin contact receiving opening 74 at one end of receptacle 70. Formed contact 10 is inserted into receptacle 70 in the direction of arrow 76 (opposite pin insertion direction 14) and is retained in receptacle 70 by several features. First, receptacle 70 includes a recessed area 78 for receiving contact 10. As contact 10 is inserted into receptacle 70, shank 22 of contact 10 slides into recessed area 78. Back edge 80 of shank 22 then abuts lip 82 of recessed area 78 and is prevented from moving out of receptacle 70. Barbs 28 also provide a retaining force by engaging the softer material of housing 72.

Receptacle 70 is preferably provided with a beam constraint 84. Beam constraint 84 is positioned within receptacle 70 to prevent shank 22 from bending out of alignment and presenting a "stubbing" condition to contact pin 48. Beam constraint 84 also minimizes vibration of the contact during, for example, ultrasonic welding operations which are performed with the finished connector. If the contact vibrates excessively, the contact may crack or be damaged in some other manner. Beam constraint 84 may be positioned on only a single side of pin 48, or alternatively a beam constraint 84 may be positioned on each side of an inserted contact pin 48.

Although the present invention has been described with reference to preferred embodiments, those skilled in the art will recognize that modifications and alterations may be employed while still remaining within the spirit and scope of the invention.

What is claimed is:

1. An electrical socket contact for connection to a contact pin by insertion of the contact pin into the socket contact along a pin insertion axis, the socket contact comprising:

a body portion defining a base plane;

a first longitudinal beam and a second longitudinal beam extending from the body portion; and a central plane coincident with the pin insertion axis and centrally located between the first longitudinal beam and normal to the base plane, the central plane the second longitudinal beam;

wherein the first longitudinal beam and the longitudinal second longitudinal beam intersect the pin insertion axis at an acute angle when viewed from a direction normal to the central plane.

2. The socket contact of claim 1, wherein the first longitudinal beam and the second longitudinal beam form mirror images of each other about the central plane.

3. The electrical socket contact of claim 1, wherein the body portion includes elements for securing the socket contact in a contact housing.

4. The electrical socket contact of claim 1, further comprising a shank extending from the body portion, the shank in parallel alignment with the pin insertion axis, wherein the first longitudinal beam and the second longitudinal beam are cantilevered from the shank.

5. The socket contact of claim 4, wherein the shank has a cross-sectional shape which conforms to a cross-sectional contour of the contact pin.

6. The socket contact of claim 5, wherein the cross-sectional shape of the shank describes an arc of a circle.

7. The socket contact of claim 1, wherein the first longitudinal beam and the second longitudinal beam form a funnel-shaped lead-in portion for receiving the contact pin.

8. An electrical connector comprising:

a housing having a contact receptacle; and a socket contact for receiving a contact pin along a pin insertion axis within the contact receptacle, the contact having:

a body portion including elements for securing the socket contact in the housing wherein the body portion defines a base plane;

a first longitudinal beam and a second longitudinal beam extending from the body portion; and a central plane coincident with the insertion axis and normal to the base plane, the central plane centrally located between the first longitudinal beam and the second longitudinal beam;

wherein the longitudinal first beam and the longitudinal second beam intersect the pin insertion axis at an acute angle when viewed from a direction normal to the central plane.

9. The electrical connector of claim 8, wherein the first longitudinal beam and the second longitudinal beam form mirror images of each other about the central plane.

10. The electrical connector of claim 8, wherein the contact receptacle includes a beam constraint for limiting movement of the socket contact within the receptacle.

11. The electrical connector of claim 8, further comprising a shank extending from the body portion of the socket contact, the shank in parallel alignment with the pin insertion axis, wherein the first longitudinal beam and the second longitudinal beam are cantilevered from the shank.

12. The electrical connector of claim 11 wherein the shank has a cross-sectional shape which conforms to a cross-sectional contour of the contact pin.

13. The electrical connector of claim 12, wherein the cross-sectional shape of the shank describes an arc of a circle.

14. The electrical connector of claim 8, wherein the first longitudinal beam and the second longitudinal beam form a funnel-shaped lead-in portion for receiving the contact pin.

15. The electrical connector of claim 8, further comprising:

a plurality of said contact receptacles in the housing; and a plurality of said socket contacts within the plurality of contact receptacles.

* * * * *

UNITED STATES PATENT AND TRADEMARK OFFICE

CERTIFICATE OF CORRECTION

PATENT NO.: 6,000,975

DATED: December 14, 1999

INVENTOR(S): Steven Feldman

It is certified that error appears in the above-identified patent and that said Letters Patent is hereby corrected as shown below:

In column 7, line 48, after "pin insertion axis" insert --normal to the base plane, the central plane--.

In Column 7, line 52, after "the first longitudinal beam and the" delete --longitudinal--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*